US006807684B2

(12) United States Patent
Lewis

(10) Patent No.: US 6,807,684 B2
(45) Date of Patent: Oct. 26, 2004

(54) PROTECTIVE GARMENT HAVING REFLECTIVE STRIP SPACED FROM OUTER SHELL EXCEPT WHERE SEWN TO OUTER SHELL

(75) Inventor: Patricia Lewis, Huber Heights, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 180 days.

(21) Appl. No.: 10/236,677

(22) Filed: Sep. 6, 2002

(65) Prior Publication Data

US 2004/0045080 A1 Mar. 11, 2004

(51) Int. Cl.[7] ..... A41D 27/08
(52) U.S. Cl. ..... 2/243.1
(58) Field of Search ..... 2/243.1, 244, 93, 2/94, 108, 69, 81, 79, 227, 102, 456

(56) References Cited

U.S. PATENT DOCUMENTS 5,054,125 A * 10/1991 Snedeker ..... 2/81
5,095,549 A * 3/1992 Aldridge ..... 2/304
5,127,106 A * 7/1992 Aldridge ..... 2/81
5,388,270 A * 2/1995 Hewitt ..... 2/93
6,009,560 A * 1/2000 McKenney et al. ..... 2/244
6,361,850 B1 * 3/2002 Billingsley et al. ..... 428/143

* cited by examiner

*Primary Examiner*—Tejash Patel
(74) *Attorney, Agent, or Firm*—Wood, Phillips, Katz, Clark & Mortimer

(57) ABSTRACT

In a protective garment, such as a firefighter's garment, of a type comprising an outer shell and a reflective strip, which is sewn to the outer shell, the reflective strip is spaced from the outer shell, except where the reflective strip is sewn to the outer shell, whereby to reduce risks of thread abrasion and to provide thermal insulation. The reflective strip may be thus spaced by a single strip interposed between two opposite margins of the reflective strip, along which margins the reflective strip is sewn to the outer shell, or by two spaced strips interposed therebetween. If two spaced strips are used, the reflective strip may be also sewn to the outer shell where the spaced strips are spaced from each other or, alternatively, the reflective strip is detached from the outer shell where the spaced strips are spaced from each other so as to define an air space between the reflective strip and the outer shell where the spaced strips are spaced from each other.

9 Claims, 1 Drawing Sheet

PROTECTIVE GARMENT HAVING REFLECTIVE STRIP SPACED FROM OUTER SHELL EXCEPT WHERE SEWN TO OUTER SHELL

TECHNICAL FIELD OF THE INVENTION

This invention pertains to a protective garment, such as a firefighter's garment, of a type comprising an outer shell and a reflective strip, which is sewn to the outer shell. This invention provides means for spacing the reflective strip from the outer shell, except where the reflective strip is sewn to the outer shell, whereby to reduce risks of thread abrasion at the reflective strip and to provide thermal insulation.

BACKGROUND OF THE INVENTION

Protective garments of the type noted above are available commercially from Morning Pride Manufacturing, L.L.C. of Dayton, Ohio, under its MORNING PRIDE trademark, and from other sources. Reflective strips for such garments are available commercially from Minnesota Mining and Manufacturing Company of Saint Paul, Minn., under its SCOTCHLITE trademark, from Reflexite Corporation of Avon, Conn., under its REFLEXITE trademark, and from other sources. Typically, a protective garment of the type noted above has multiple reflective strips, on arm portions, on leg portions, and elsewhere.

Heretofore, when a protective garment of the type noted above was worn under adverse conditions, threads used to sew the reflective strip were susceptible, where exposed, to possible abrasion, particularly if its wearer, such as a firefighter, crawled on or brushed against an abrasive object. Furthermore, as the reflective strip tends to be more prominent when compared to neighboring portions of the outer shell, the reflective strip might be accidentally pressed against a heated surface, whereby to pose a burn risk to the wearer, even though neighboring portions of the outer shell remained spaced from the heated surface.

SUMMARY OF THE INVENTION

This invention provides a protective garment comprising an outer shell and comprising a reflective strip, which is sewn to the outer shell, wherein the protective garment comprises means for spacing the reflective strip from the outer shell, except where the reflective strip is sewn to the outer shell. Preferably, the reflective strip has two opposite margins, along which the reflective strip is sewn to the outer shell.

In one contemplated embodiment, the spacing means comprised a single strip, which is interposed between the opposite margins. In an alternative embodiment, the spacing means comprises two spaced strips, which are interposed between the opposite margins and which are spaced from each other. If two spaced strips are used, the reflective strip may be also sewn to the outer shell where the spaced strips are spaced from each other or, alternatively, the reflective strip is detached from the outer shell where the spaced strips are spaced from each other so as to define an air space between the reflective strip and the outer shell where the spaced strips are spaced from each other.

Advantageously, whether a single strip or two spaced strips are used, risks of thread abrasion at the reflective strip are reduced, as threads used to sew the reflective strip to the outer shell are not exposed where the reflective strip tends to be most prominent when compared to neighboring portions of the outer shell.

Additionally, if a single strip is used to space the reflective strip from the outer shell, the single strip provides thermal insulation between the reflective strip and the outer shell. Similarly, if two spaced strips are used to space the reflective strip from the outer shell, the spaced strips provide thermal insulation between the reflective strip and the outer shell.

Similarly, if two spaced strips are used to space the reflective strip from the outer shell and if the reflective strip is detached from the outer shell where the spaced strips are spaced from each other so as to define an air space between the reflective strip and the outer shell where the spaced strips are spaced from each other, the spaced strips and air in the air space provide thermal insulation between the reflective strip and the outer shell.

BRIEF DESCRIPTION OF THE DRAWINGS

FIG. 2 illustrates the protective garment disposed against an abrasive object, such as a sidewalk.

DETAILED DESCRIPTION OF THE ILLUSTRATED EMBODIMENTS

Figure 1:
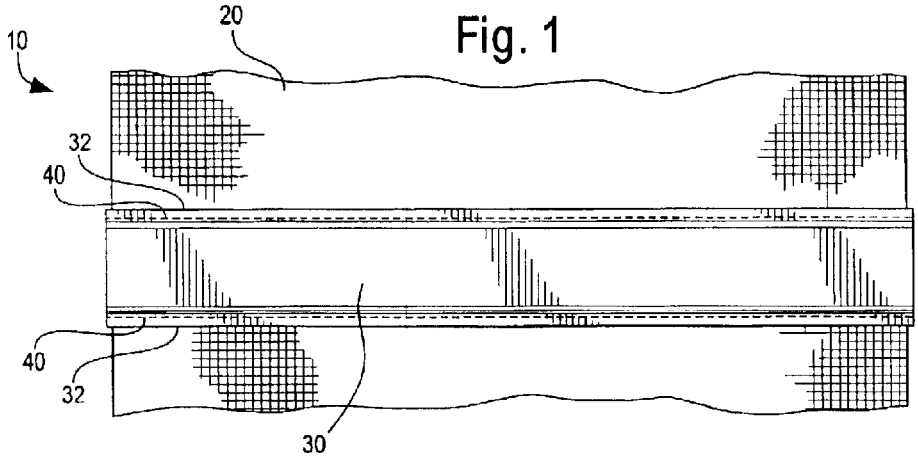
FIG. 1 is a fragmentary, outer elevation of a portion of an exemplary embodiment of a protective garment, such as a firefighter's garment, which comprises an outer shell and a reflective strip, as sewn to the outer shell of the protective garment in a manner contemplated by this invention.
Figure 2:
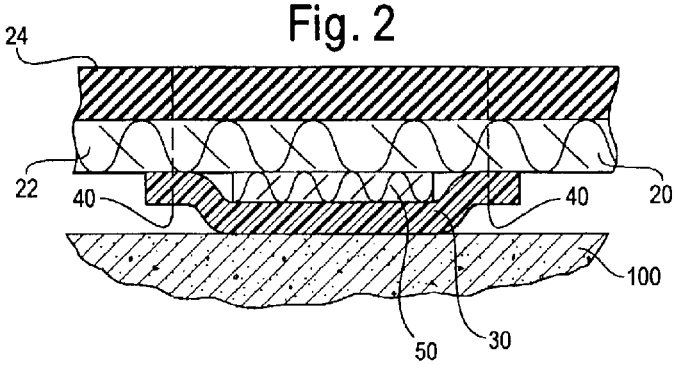
FIGS. 2, 3, and 4, on a larger scale with thicknesses exaggerated for illustrative purposes, are fragmentary, cross-sections, respectively, of the aforesaid embodiment and of two alternative embodiments of this invention.

In the contemplated embodiment illustrated in FIGS. 1 and 2, a protective garment 10, such as a firefighter's garment, comprises an outer shell 20 and a reflective strip 30, which is sewn to the outer shell 20, via two lines of threads 40, along two opposite margins 32 of the reflective strip 30. As illustrated in FIG. 2, a single strip 50 is provided for spacing the reflective strip 30 from the outer shell 20, except where the reflective strip 30 is sewn to the outer shell 20, whereby to reduce risks of thread abrasion at the reflective strip 30, where the lines of threads 40 are exposed, and whereby to provide thermal insulation between the reflective strip 30 and the outer shell 20.

The outer shell 20 has an outer, abrasion-resistant layer 22 and, optionally, an inner, moisture-impervious layer 24, both being conventional in an outer shell of a protective garment, such as a firefighter's garment, which is available commercially, as discussed above. The reflective strip 30, which is illustrated schematically in FIG. 2, is one that is available commercially, as discussed above. The single strip 50 is made of any suitable felted, woven, or non-woven fabric. Threads 40 are conventional.

After the single strip 50 has been interposed between the opposite margins 32 and disposed against the outer layer 22 so as to space the reflective strip 50 from the outer layer 22, the reflective strip 30 is sewn to the outer layer 22, along the opposite margins 32, via the lines of threads 40, which pass through the opposite margins 32, through the outer layer 22, and through the inner layer 24. Thus, risks of thread abrasion are reduced, even if the reflective strip 50 is brushed against an abrasive object 100, such as a concrete sidewalk. Also, the single strip 50 provides thermal insulation between the reflective strip 30 and the outer layer 22 of the outer shell 20.

Figure 3:
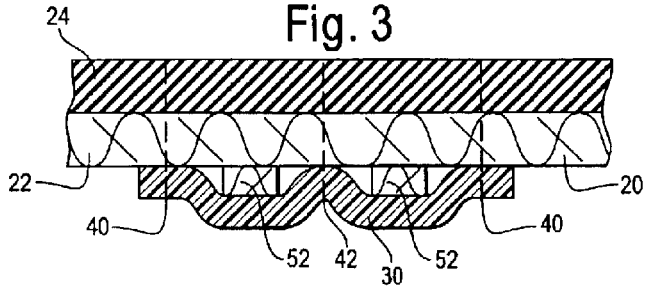

The alternative embodiment illustrated in FIG. 3 is similar to the contemplated embodiment of FIGS. 1 and 2, except that the single strip 40 is replaced by two spaced strips 52, which are made of any suitable felted, woven, or non-woven fabric, which are interposed between the opposite margins 32, and which are spaced from each other, and except that the reflective strip 30 is sewn to the outer layer 22, via another line of threads 42, which are similar to the lines of threads 40, where the spaced strips 52 are spaced from each other. Thus, as in the contemplated embodiment illustrated in FIGS. 1 and 2, risks of thread abrasion are reduced. Also, the spaced strips 52 provide thermal insulation between the reflective strip 30 and the outer layer 22.

Figure 4:
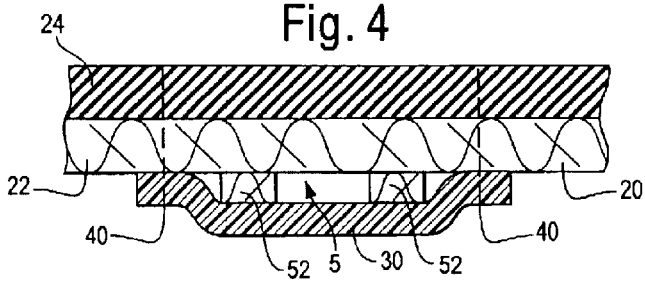

The alternative embodiment illustrated in FIG. 4 is similar to the alternative embodiment illustrated in FIG. 3, except that the reflective strip 30 is detached from the outer layer 22 where the spaced strips 52 are spaced from each other so as to define an air space S between the reflective strip 30 and the outer layer 22 where the spaced strips 52 are spaced from each other. Thus, as in the contemplated embodiment illustrated in FIGS. 1 and 2, risks of thread abrasion are reduced. Also, along with air in the air space S, the spaced strips 52 provide thermal insulation between the reflective strip 30 and the outer layer 22.

What is claimed is:

1. A protective garment comprising an outer shell and comprising a reflective strip, which is sewn to the outer shell, wherein the protective garment comprises means for spacing the reflective strip from the outer shell, except where the reflective strip is sewn to the outer shell.

2. The protective garment of claim 1 wherein the reflective strip has two opposite margins, along which the reflective strip is sewn to the outer shell.

3. The protective garment of claim 2 wherein the spacing means comprised a single strip, which is interposed between the opposite margins.

4. A protective garment comprising an outer shell and comprising a reflective strip, which is sewn to the outer shell, wherein the protective garment comprises means for spacing the reflective strip from the outer shell, except where the reflective strip is sewn to the outer shell, wherein the reflective strip has two opposite margins, along which the reflective strip is sewn to the outer shell, and wherein the spacing means comprises two spaced strips, which are interposed between the opposite margins and which are spaced from each other.

5. The protective garment of claim 4 wherein the reflective strip is sewn to the outer shell where the spaced strips are spaced from each other.

6. The protective garment of claim 4 wherein the reflective strip is detached from the outer shell where the spaced strips are spaced from each other so as to define an air space between the reflective strip and the outer shell where the spaced strips are spaced from each other.

7. The protective garment of claim 4 wherein the reflective strip engages the outer shell where sewn to the outer shell.

8. The protective garment of claim 5 wherein the reflective strip engages the outer shell where sewn to the outer shell.

9. The protective garment of claim 6 wherein the reflective strip engages the outer shell where sewn to the outer shell.

* * * * *